US007513657B2

(12) United States Patent
Den Boer

(10) Patent No.: US 7,513,657 B2
(45) Date of Patent: Apr. 7, 2009

(54) ILLUMINATION DEVICE, HOUSING AND MANUFACTURING METHOD OF SUCH A HOUSING

(75) Inventor: Anne Huig Den Boer, Streefkerk (NL)

(73) Assignee: In-Lite Design B.V., Nieuw-Lekkerland (NL)

( * ) Notice: Subject to any disclaimer, the term of this patent is extended or adjusted under 35 U.S.C. 154(b) by 0 days.

(21) Appl. No.: 11/483,739

(22) Filed: Jul. 11, 2006

(65) Prior Publication Data

US 2008/0013326 A1 Jan. 17, 2008

(51) Int. Cl.
*F21V 17/00* (2006.01)

(52) U.S. Cl. ..... 362/364; 362/365; 362/368; 248/181.1

(58) Field of Classification Search ..... 362/287, 362/364, 365, 368, 371; 248/181.1, 181.2
See application file for complete search history.

(56) References Cited

U.S. PATENT DOCUMENTS 6,626,554 B2 * 9/2003 Rincover et al. ..... 362/186

* cited by examiner

*Primary Examiner*—John A Ward
(74) *Attorney, Agent, or Firm*—Young & Thompson

(57) ABSTRACT

An illumination device includes a housing a portion of which has a ball-like outer surface, a positioning base and an annular ring. The housing is arranged to accommodate a Light Emitting Diode (LED) and is at least partially transparent to wavelengths the LED is capable of emitting. The positioning base has a front side provided with an opening and is arranged to rotatably support the ball-like outer surface portion of the housing. The front side of the positioning base has a front surface with a recess. The recess is arranged to accommodate the annular ring in such a way that an orientation of the housing can be tightened.

14 Claims, 2 Drawing Sheets

ILLUMINATION DEVICE, HOUSING AND MANUFACTURING METHOD OF SUCH A HOUSING

BACKGROUND OF THE INVENTION

The present invention relates to an illumination device comprising at least one light -emitting-diode (LED) that can be rotatably mounted. Generally, LEDs are fixed in an illumination device. By positioning the illumination device, the direction of the light it emits is fixed. In numerous situations, however, it is desired to adapt the direction of light after positioning the illumination device without changing the position of that illumination device.

U.S. Pat. No. 6,315,432 discloses a rotatable LED-arrangement adjusted to emit infrared in the direction of a detector. The rotatable LED-arrangement includes a housing for retaining a LED-member in a specially developed chamber. The housing has a partially ball-shaped portion that can be rotated in a suitably adapted positioning base. The LED emits infrared light forming a conical infrared covering zone. The rotatable LED-arrangement can be easily adjusted to follow tracks of position-changing detectors. However, as the direction of the light emitted by this LED-arrangement is easily adjustable, it is not robust for external influences, e.g. accidental contact by passing human beings.

BRIEF SUMMARY OF THE INVENTION

It is desirable to provide an illumination device comprising a rotatable LED, for which the direction of light emission is more robust for external influences than illation devices presently available.

To that end, in an embodiment, the invention provides an illumination device comprising;

a housing, a portion of which has a ball-like outer surface, the housing arranged to accommodate at least one Light Emitting Diode (LED) and being at least partially transparent to wavelengths the at least one LED is capable of emitting;

a positioning base comprising a front side provided with an opening, the positioning base being arranged to rotatably support the ball-like outer surface portion of the housing; and an annular ring;

wherein the front side has a front surface comprising a recess arranged to accommodate the annular ring such that an orientation of the housing can be tightened.

In an embodiment the invention further relates to a housing for emitting light in an adjustable direction, the housing comprising:

at least one Light Emitting Diode (LED), the at least one LED having an emission side and a non-emission side;

a cylindrical structure having an internal and an external surface and arranged to accommodate the at least one LED, the cylindrical structure extending beyond the non-emission side of the at least one LED such that at the non-emission side of the at least one LED a cavity is formed;

wherein, at the emission side of the at least one LED, at least a portion of the housing has a ball-like outer surface and is transparent to wavelengths the at least one LED is capable of emitting.

Finally, in an embodiment, the invention further relates to a method of manufacturing such a housing, the method comprising:

providing at least one Light Emitting Diode (LED), said at least one LED having an emission side and a non-emission side;

providing a cylindrical structure;

positioning the at least one LED in said cylindrical structure such that the cylindrical structure extends beyond the non-emission side of said at least one LED such that at the non-emission side of the at least one LED a cavity is formed;

positioning the cylindrical structure and said at least one LED in a mold;

molding a layer at the emission side of said at least one LED in a mold to form a housing wherein said layer is of a material at least partially transparent to light the at least one LED is capable of emitting and at least a portion of said housing has a ball-like outer surface.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE INVENTION

Figure 1:
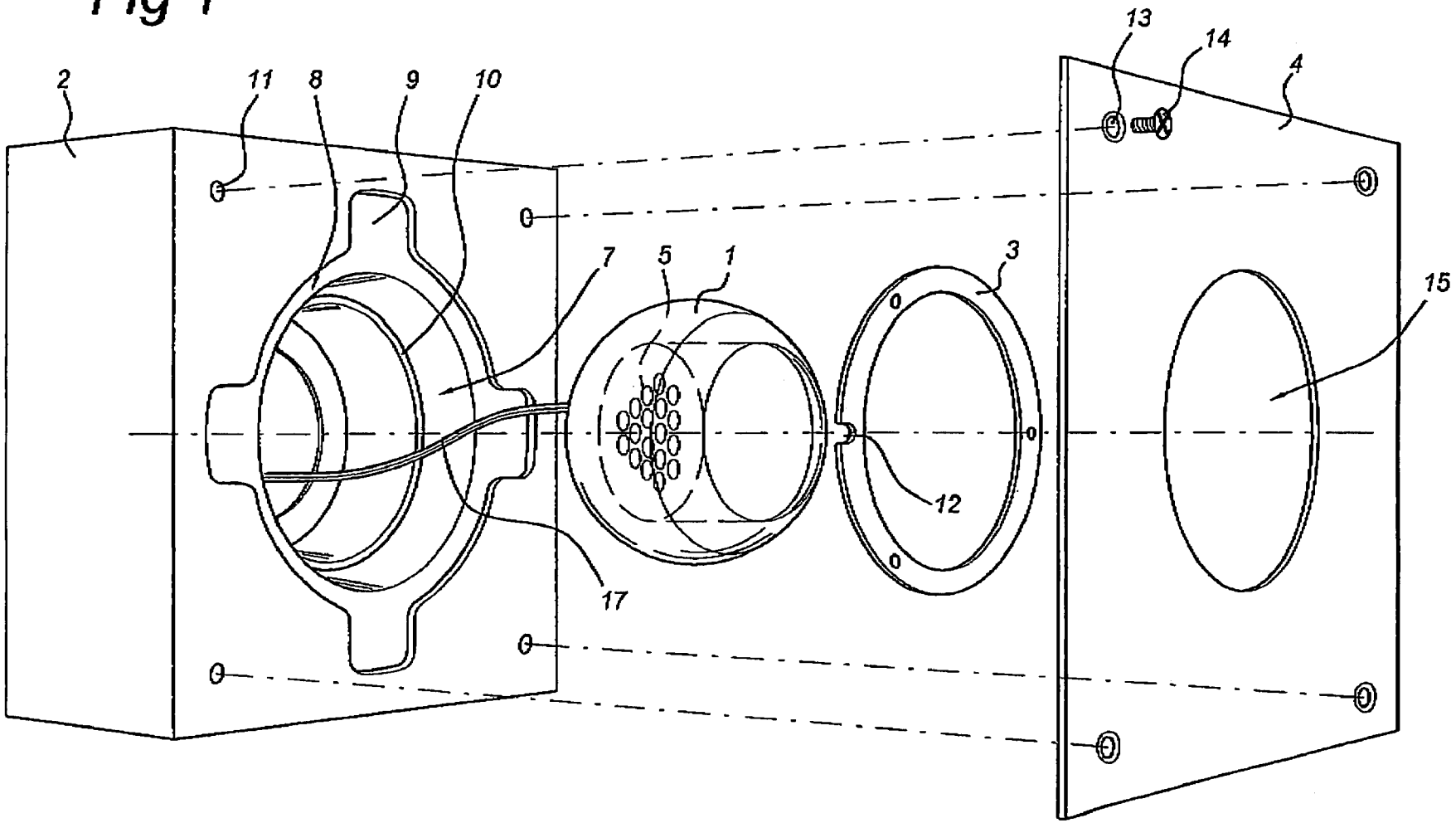
FIG. 1 schematically depicts an exploded view of an illumination device according to an embodiment of the invention.

FIG. 1 schematically depicts an exploded view of an illumination device according to an embodiment of the invention. The illumination device comprises a housing 1, a portion of which has a ball-like outer surface, a positioning base 2 and an annular ring 3. The housing 1 is arranged to accommodate at least one Light Emitting Diode (LED) 5 and is at least partially transparent to wavelengths the at least one LED 5 is capable of emitting. The positioning base 2 comprises a front side provided with an opening 7. The positioning base 2 is arranged to rotatably support the ball-like outer surface portion of the housing 1. The front side of the positioning base 2 has a front surface comprising a recess 8 to arranged to accommodate said annular ring 3 in such a way that an orientation of the housing 1 can be tightened.

In the embodiment schematically depicted in FIG. 1, the positioning base 2 further comprises a holding cup 10. The holding cup 10 is provided in the opening 7 and comprises sides walls arranged to rotatably support the ball-like outer surface portion of the housing 1. In this way, the housing 1 may be supported more inward by the positioning base 2 as compared to the situation where the housing 1 would be supported by the front side of the positioning base 2. The more inward support may decrease the vulnerability of the housing 1 to external damage or the like.

In the embodiment schematically depicted in FIG. 1, the illumination device further comprises a cover plate 4. The cover plate may be connected to the positioning base 2, e.g. by means of screws 14, (hex) bolts etc., and may therefore be provided with suitable holes 13. The cover plate 4 may be made of stainless steel. The cover plate 4 may protect the tightened orientation of the housing 1 by means of the annular ring 3. Similarly, positioning base 2 may be provided with holes 11 to facilitate aforementioned connecting possibility. The cover plate 4 comprises an opening 15 with a diameter large enough to avoid contact with the housing 1 when connected to the positioning base 2.

The at least one LED 5 may be connected to a power supply, e.g. a current source, via an electrical connection, e.g. via an electrical cord 17. The power supply may be provided in the positioning base 2, e.g. a battery, solar cell etc., or may be an external power supply.

In case there are more than one LED 5, i.e. the housing 1 comprises a plurality of LEDs 5, the plurality of LEDs may comprise different types of LEDs. For instance, in an embodiment, the plurality of LEDs comprises at least two different types of LEDs in which each type of LED is arranged to emit light of a different color. In an embodiment, by suitable arrangement of blue LEDs, i.e. LEDs arranged to emit light with a wavelength between 450 and 490 nm, red LEDs, i.e. LEDs arranged to emit light with a wavelength between 600 and 650 nm and green LEDs, i.e. LEDs arranged to emit light with a wavelength between 500 and 550 nm, white light may be formed.

Figure 2:
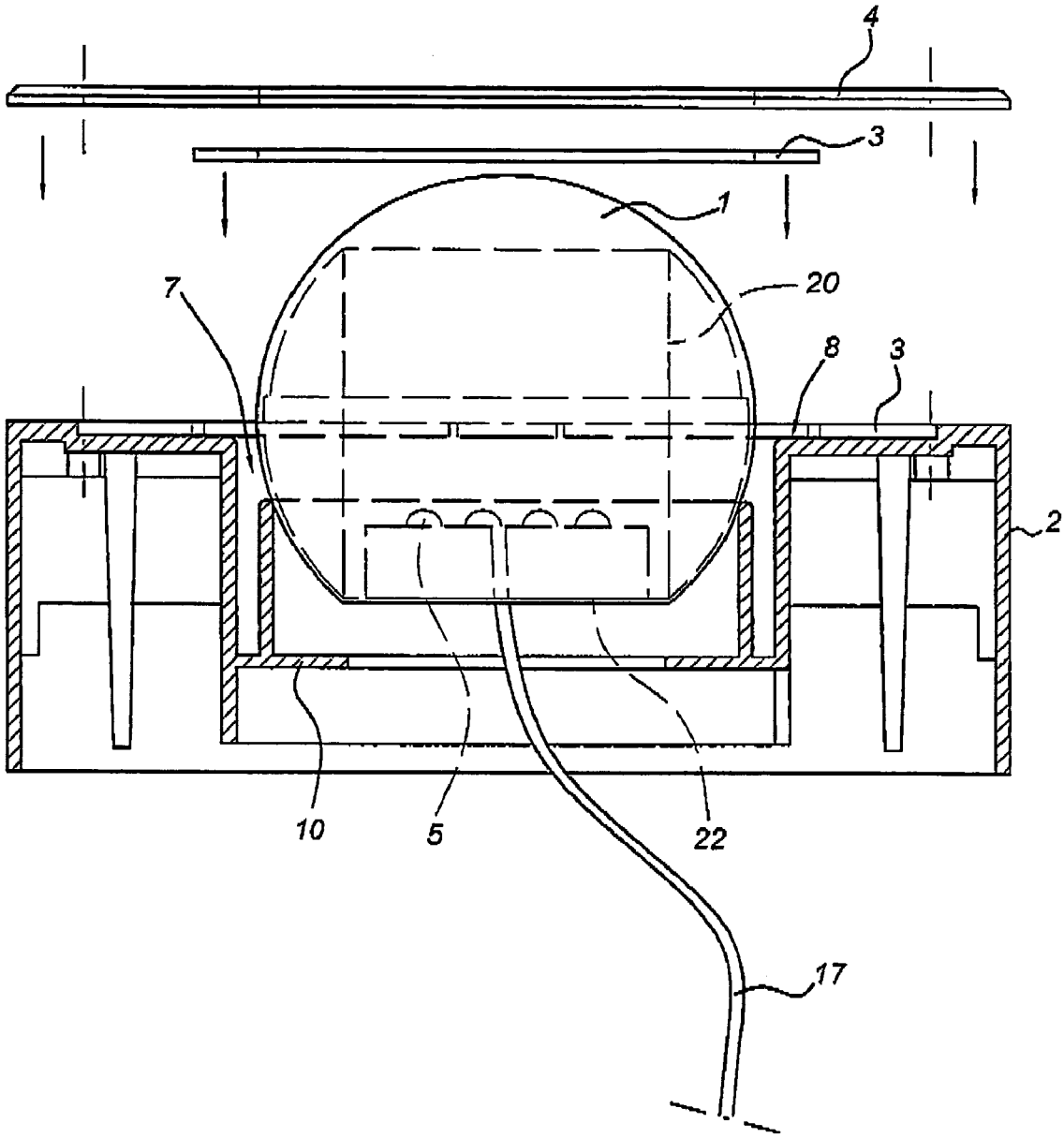
FIG. 2 schematically depicts a cross-sectional view of the illumination device of FIG. 1.

FIG. 2 schematically depicts a cross-sectional view of the illumination device of FIG. 1. As can be seen, in this embodiment the positioning base 2 comprises several additional cavities that reduce the weight of the positioning base 2 and provide additional space for accommodating additional components, e.g. a power source like a battery. The positioning base 2 may be manufactured by techniques known in the art like injection molding.

In an embodiment, the holding cup 10 may be an integral part of the positioning base 2, as depicted in FIG. 2. However, the holding cup 10 may also be a separate element that is attached to the positioning base 2, e.g. by using a suitable type of glue.

The housing 1 comprises at least one LED 5, in this case a plurality of LEDs 5. The plurality of LEDs may be positioned in a cylindrical structure 20. The cylindrical structure may be a plastic and its inner surface, i.e. the surface facing the plurality of LEDs 5, may be provided with a reflective coating. The reflective coating procures that light emitted by the plurality of LEDs is reflected on the inner surface of the cylindrical structure 20 and is among other due to the ball-like outer surface portion of the housing 1 emitted as a bundle in a direction determined by the orientation of the housing 1. The distance between the cylindrical structure 20 and the ball-like outer surface portion of the housing 1 has an influence on the spread of the bundle. Thus, in case the size of the housing 1 is fixed, a reduction of the height of the cylindrical structure 20 will cause a broader light bundle, provided the housing 1 is at least partially transparent throughout the optical path of the bundle. The cylindrical structure 20 may be provided with holes (not shown) to provide creative illumination effects. The cylindrical structure may be covered in the transparent material forming the ball-like outer surface portion of the housing 1. The transparent material may be polycarbonate.

The cylindrical structure 20 may extend beyond a non-emitting side, in FIG. 2 the bottom side, of the plurality of LEDs 5 so as to leave a cavity 22. The cavity 22 accommodates electrical connection, e.g. via an electrical cord 17, of the plurality of LEDs with a power supply. In the embodiment depicted in FIG. 2, the power supply is an external power supply. The cavity 22 may be filled with a fixation material, e.g. a suitable type of (two-component) resin. The fixation material may prevent the electrical connection, e.g. via the electrical cord 17, of the power supply with the plurality of LEDs from twisting and/or buckling, when changing the orientation of the housing 1. Such twisting and/or buckling may lead to deterioration of the electrical connection, and eventually, may even terminate aforementioned electrical connection.

The illumination device depicted in FIGS. 1 and 2 is suitable to be installed in pavements, car parks or the like. Alternatively, the illumination device may have a different shape for use in other applications. For instance, the positioning base may be elongated or positioned on a column or the like to form a lamp. In another application, the positioning base 2 is arranged to be mountable to a wall or another vertical structure.

The housing 1 as schematically depicted in FIG. 2 may be manufactured by means of molding. After providing the at least one LED 5 and the cylindrical structure 20 the at least one LED 5 is positioned in the cylindrical structure 20 in such a way that a cavity 22 is formed. Subsequently, at the emission side of the at least one LED 5, aforementioned combination of cylindrical structure 20 and at least one LED 5 is covered by a layer of a material at least partially transparent to the light the at least one LED 5 is capable of emitting. In order to provide the ball-like outer surface of the housing 1, aforementioned covering action may be performed by molding, as will be understood by a person skilled in the art. In an embodiment, the layer material is a suitable polycarbonate. At the non-emission side of the at least one LED 5, an electrical connection may be established by accommodating an electrical connection, e.g. an electrical cord 17, in the cavity 22. In an embodiment, the cavity is filled with a suitable resin to strengthen this connection, i.e. risks related to twisting and/or buckling of an electrical connection, e.g. an electrical cord 17, are minimized.

The description above is intended to be illustrative, not limiting. It only sets out a number of possible embodiments of the present invention. It is easy to appreciate that many alternative embodiments of the invention can be conceived, all of which fall within the scope of the invention. Thus, it will be apparent to one skilled in the art that modifications may be made to the invention as described without departing from the scope of the claims set out below.

The invention claimed is:

1. Illumination device comprising:

a housing arranged to accommodate at least one Light Emitting Diode (LED), a portion of said housing having a ball-shaped outer surface, the material of said housing, including at least part of said ball-shaped outer surface being at least partially transparent to wavelengths the at least one LED is arranged to emit;

a positioning base comprising a front side provided with an opening, said positioning base being arranged to rotatably support the ball-shaped outer surface portion of said housing; and an annular ring;

wherein said front side is an emitting side and has a front surface comprising a recess arranged to accommodate said annular ring, said annular being tightened against said ball-shaped outer surface of said housing such that an orientation of the housing is maintained, and wherein said housing is supported inside of the positioning base below the recess.

2. Illumination device according to claim 1, wherein said positioning device comprises a holding cup provided in said opening, said holding cup comprising side walls arranged to roratably support the ball-like outer surface portion of the housing.

3. Illumination device according to claim 2 wherein said holding cup is an integral part of said positioning base.

4. Illumination device according to claim 1, wherein said illumination device further comprises a cover plate provided with a hole such that part of the housing extends through the hole.

5. Illumination device according to claim 1, wherein said illumination device further comprises a power supply.

6. Illumination device according to claim 1, wherein said at least one LED is a plurality of LEDs, said plurality of LEDs comprising at least two types of LEDs, each type of LED arranged to emit light of a different color.

7. The illumination device according to claim 1, wherein the housing is arranged for emitting light in an adjustable direction, the housing comprising:

at least one Light Emitting Diode (LED), the at least one having an emission side and a non-emission side; and a cylindrical structure having an internal and an external surface and arranged to accommodate the at least one LED; wherein, at the emission side of the at least one LED, the housing has a ball-shaped outer surface and a material of said housing, including at least part of said ball-shaped outer surface is at least partially transparent to wavelengths that the at least one LED is capable of emitting.

8. The illumination device according to claim 7, wherein the housing comprises a cavity, the cavity being arranged to accommodate an electrical connection for connecting the at least one LED with a power supply.

9. The illumination according to claim 8, wherein said cavity is filled with a resin to establish said arrangement to accommodate an electrical connection.

10. The illumination device according to claim 7, wherein said internal surface of said cylindrical structure is reflective for the light the at least one LED is capable of emitting.

11. Method of manufacturing an illumination device comprising a housing according to claim 7, said method comprising:

providing at least one Light Emitting Diode (LED), said at least one LED having an emission side and a non-emission side;

providing a cylindrical structure;

positioning the at least one LED in said cylindrical structure such that the cylindrical structure extends beyond the non-emission side of said at least one LED such that at the non-emission side of the at least one LED a cavity is formed;

positioning the cylindrical structure and said at least one LED in a mold;

molding a layer at the emission side of said at least one LED in a mold to form a housing of which at least a portion has a ball-shaped outer surface, wherein said layer is of a material at least partially transparent to light the at least one LED is capable of emitting, such that said at least one LED at its emission side is covered by said layer.

12. Method according to claim 11, wherein the method further comprises accommodating an electrical connection between said at least one LED and a power supply.

13. Method according to claim 12, wherein said accommodating an electrical connection is by filling said cavity with a resin.

14. An illumination device, comprising:

a housing arranged to accommodate at least one Light Emitting Diode (LED), a portion of said housing having a ball-shaped outer surface, the material of said housing, including at least part of said ball-shaped outer surface being at least partially transparent to wavelengths the at least one LED is arranged to emit;

a positioning base comprising a front side provided with an opening, said positioning base being arranged to rotatably support the ball-shaped outer surface portion of said housing; and an annular ring;

wherein said front side is an emitting side and has a substantially planar front surface comprising a substantially planar recess, said annular ring sitting within said recess, said annular ring being tightened against said ball-shaped outer surface of said housing to maintain an orientation of the housing.

* * * * *